US006239766B1

(12) United States Patent
Smith et al.

(10) Patent No.: US 6,239,766 B1
(45) **Date of Patent: *May 29, 2001**

(54) RADIATION SHIELDING DEVICE

(75) Inventors: Adrian David Smith; Paul Clark, both of Paignton (GB)

(73) Assignee: Nortel Networks Limited, Quebec (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/753,846

(22) Filed: Dec. 2, 1996

(30) Foreign Application Priority Data

Dec. 5, 1995 (GB) ..... 9524912

(51) Int. Cl.[7] ..... H01Q 1/52; H01Q 21/28

(52) U.S. Cl. ..... 343/841; 343/700 MS; 343/795

(58) Field of Search ..... 343/700 MS, 841, 343/778, 813, 815, 833, 834, 795; H01Q 21/00, 21/28, 1/52, 1/38

(56) References Cited

U.S. PATENT DOCUMENTS

| | | | | |
|---|---|---|---|---|
| 2,996,710 | | 8/1961 | Pratt | 343/18 |
| 3,681,769 | * | 8/1972 | Perrotti et al. | 343/815 |
| 4,386,354 | | 5/1983 | Watson | 343/18 A |
| 4,439,768 | * | 3/1984 | Ebneth et al. | 343/909 |
| 4,527,165 | * | 7/1985 | De Ronde | 343/778 |
| 4,794,396 | * | 12/1988 | Pothier | 343/841 |
| 4,827,276 | * | 5/1989 | Fukuzawa et al. | 343/778 |
| 4,888,597 | * | 12/1989 | Rebiez et al. | 343/778 |
| 5,828,339 | * | 10/1998 | Patel | 343/700 MS |

FOREIGN PATENT DOCUMENTS

| | | |
|---|---|---|
| 0 941 216 | 4/1971 | (DE) . |
| 0 186 517 | 7/1986 | (EP) . |
| 0 542 447 | 5/1993 | (EP) . |
| 0 667 649 | 8/1995 | (EP) . |
| 0 454 032 | 10/1997 | (EP) . |
| 2 202 091 | 9/1988 | (GB) . |
| 2 241 831 | 9/1991 | (GB) . |
| WO 84/03005 | 8/1984 | (WO) . |

* cited by examiner

*Primary Examiner*—Michael C. Wimer
(74) *Attorney, Agent, or Firm*—Lee, Mann, Smith, McWilliams, Sweeney & Ohlson

(57) ABSTRACT

The present invention relates to antennas. One of the problems which arises during operation of antenna arrangements is that spurious signals are emitted from mounting apertures and other surface features associated with a rearwardly facing ground plane, for instance, mounting bolts which couple some of the radiated energy, and through coaxial cable connector ports. The effect of all these unwanted signals is that they will couple with other radiating elements to form intermodulation products. In receive mode these intermodulation signals can severely impair the received signal quality. The present invention provides an antenna assembly comprising a support frame 52 and individually mounted layered antennas 56, wherein an insulator-conductor sheet such as a metallized plastics film 54 is interposed between the antennas and the support frame. There is also provided a method of manufacturing such a layered antenna and of receiving and transmitting signals by means of a layered antenna of this construction.

9 Claims, 6 Drawing Sheets

21
27
11
11
13
24
12
10
14
16

44
40
42
52
X
X
0
1
2
3

RADIATION SHIELDING DEVICE

FIELD OF THE INVENTION

This invention relates to a radiation shielding device and in particular relates to radiation control means for antennas.

BACKGROUND OF THE INVENTION

Antennas for use in telecommunications operate at many different frequencies. Transmit and receive wavebands may be separated so that interference between the signals is reduced, as in GSM and other systems. Intermodulation products may, however, still result, and transmit and receive signals may interfere between themselves. Intermodulation products in receive band signals are particularly undesirable; the operating capacity is reduced and/or the callers cannot clearly communicate, whilst operators face lost calls and accordingly a reduction in revenue.

One form of layered antenna (an antenna having ground planes, feed networks and dielectric spacers arranged in layers) is known from British Patent GB-B-2261554 (Northern Telecom) and comprises a radiating element including a pair of closely spaced correspondingly apertured ground planes with an interposed printed film circuit, electrically isolated from the ground planes, the film circuit providing excitation elements or probes within the areas of the apertures, to form dipoles, and a feed network for the dipoles. Typically, there is a linear arrangement of a plurality of such aperture/element configurations are spaced at regular intervals co-linearly in the overall layered/triplate structure to form a linear array. This type of antenna lends itself to a cheap yet effective construction for a linear array antenna such as may be utilised for a cellular telephone base station, with the antenna arrays being mounted on a frame.

One of the problems which arises during operation is that spurious signals are emitted from mounting apertures and other surface features associated with the reflector plane, for instance, mounting bolts which couple some of the radiated energy, and coaxial cable connector ports. Further, the coaxial cable and/or the cable termination assembly may also radiate spurious signals. The effect of all these unwanted signals is that they will couple with other radiating elements to form intermodulation products. In receive mode these intermodulation signals can severely impair the received signal quality, since they will be of a power level comparable to the received signal strength. In a transmit mode the output power will be reduced to a certain extent and these intermodulation products can affect the beamshape in an indeterminable fashion.

Careful design of the dimensions of the apertures and the elements coupled with the design of the electrical characteristics of the feed network for the elements can give a measure of control of coupling, but for some applications this is not effective. In such cases the performance of the antenna has to be adjusted upon installation, which complicates such a procedure and does not, in fact, solve the problem of spurious radiative effects behind the antenna. These problems are not limited to layered (tri-plate) antennas.

OBJECT OF THE INVENTION

It is an object of the invention to ameliorate the above mentioned problems.

STATEMENT OF INVENTION

According to the present invention there is provided an antenna assembly comprising a support frame and individually mounted antenna elements, wherein a flexible insulator-conductor sheet is interposed between the antenna elements and the support frame. Radiation emitted rearwardly from each antenna is thus prevented whereby the generation of intermodulation products is substantially eliminated. Thus the antenna can receive signals which are not degraded by the presence of such intermodulation products due to radiation reflected from emissions radiated rearwardly of the antennas and each individually mounted antenna element operates independently. The use of a flexible metallised plastics sheeting is preferred since it is both low cost and simple. Apertures for coaxial cables and mounting bolts are required in the sheeting but, if not unduly large, will not compromise the effect of the sheilding.

In accordance with another aspect of the invention, there is provided a method of constructing an antenna arrangement, wherein, in the assembly of an antenna comprising a frame and a number of layered antenna elements, a flexible insulator-conductor sheet is inserted between the layered antenna elements and the frame, with apertures being defined therein to aid connection of coaxial feeder cables and attachment of the radiating elements with connecting means.

In accordance with a yet further aspect of the invention, there is also provided a method of receiving and transmitting radio signals in a cellular arrangement including an antenna assembly comprising a support frame and individually mounted layered antenna elements, wherein a flexible insulator-conductor sheet is interposed between the antenna elements and the support frame, wherein the method comprises, in a transmission mode, the steps of feeding signals from transmit electronics to the antenna elements via feeder cables and, in a receive mode, the steps of receiving signals via the antenna elements and feeder cables to receive electronics wherein radiative coupling effects from one antenna element coupling with another antenna element due to radiation emitted from the back plane and feeder cables are minimised.

BRIEF DESCRIPTION OF THE DRAWINGS

Embodiments of the invention will now be described with reference to the accompanying drawings in which.

DETAILED DESCRIPTION OF PREFERRED EMBODIMENTS

Figure 1:
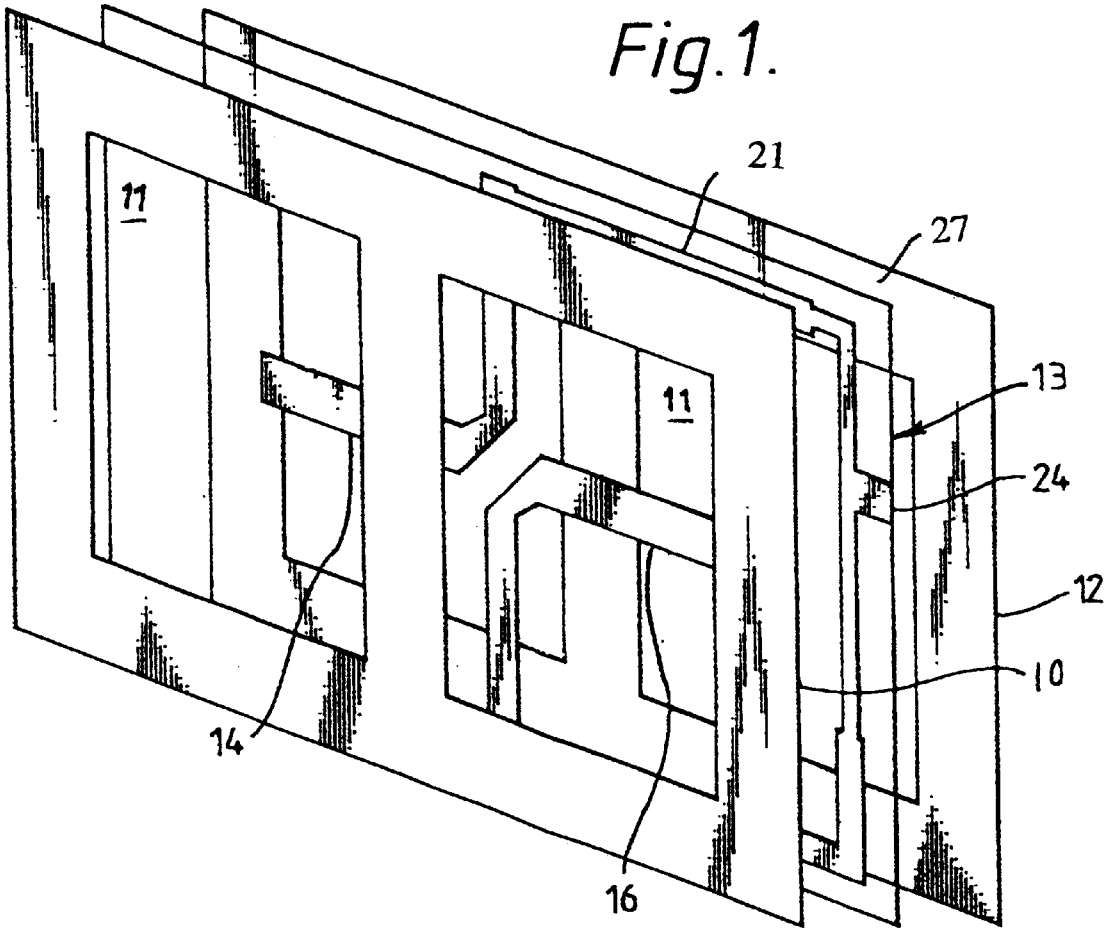
FIG. 1 is an exploded perspective view of a single element layered antenna.

The layered antenna element shown in FIG. 1 comprises a first metallic ground plane 10 having a pair of identical rectangular apertures 11, a second metallic ground plane 12 and an insulating substrate 13 which is positioned between the two ground planes. On one surface of the substrate there is a metallic conductor pattern which consists of a pair of radiating probes 14, 16 and a common feed network 22. A feed point 24 is provided for connection to an external feed (not shown). The feed network 21 is positioned so as to form a microstrip transmission line with portions of the ground planes defining the rectangular apertures. The position of the feed point 24 is chosen so that when an r.f. signal of a given frequency is fed to the network the relative lengths of the two portions of the network 21 are such as to cause the pair of probes 14 and 16 to be fed in anti-phase, thereby creating a dipole antenna radiating element structure. Furthermore, the dimensions of the rectangular apertures and the bounding portions of the ground plane are chosen so that the bounding portions 27 parallel with the probes 14, 16 act as parasitic antenna radiating elements, which together with the pair of radiating probes 14, 16 shape the radiation pattern of the antenna.

The ground planes are spaced from the plane of the feed network by dielectric spacing means (not shown) so that the feed network is equally spaced from both ground planes. Spacing between the network and the ground planes can be determined by foamed dielectric sheets or dielectric studs interposed between the various layers. Alterative mechanical means for maintaining the separation of the feed conductor network may be employed, especially if the feed network is supported on a rigid dielectric.

Figure 2:
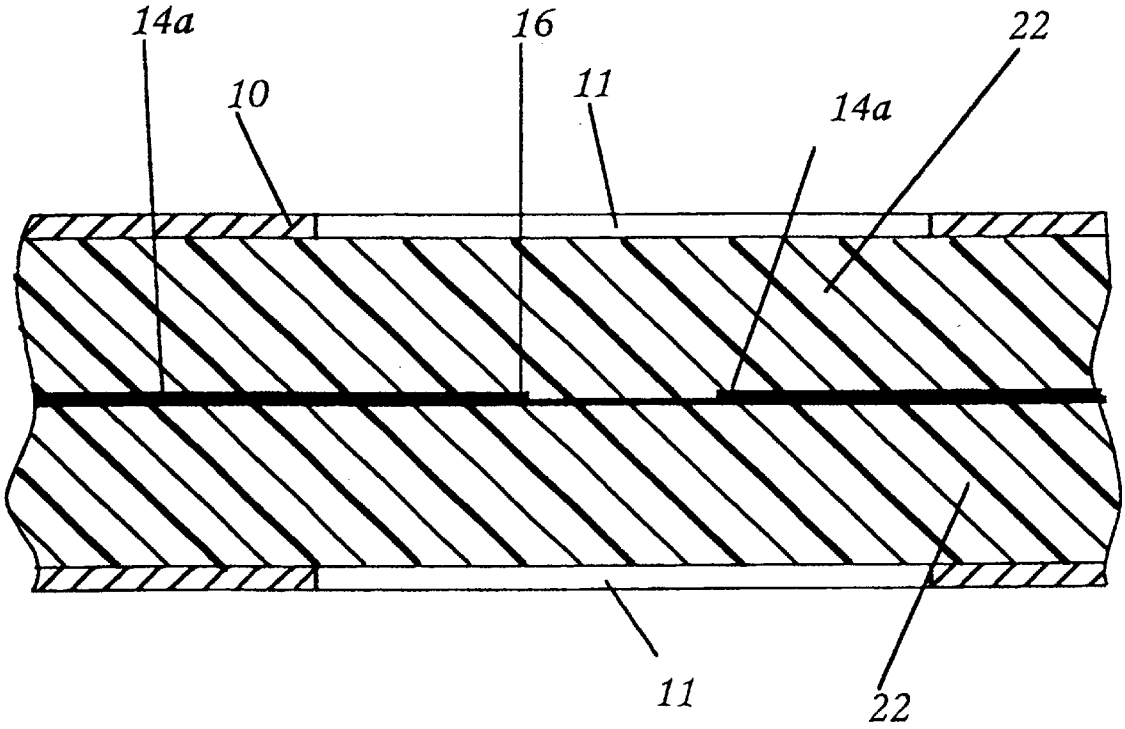
FIG. 2 is a sectional view of a second type of layered antenna.

With reference to FIG. 2, there is shown a layered antenna constructed from a first apertured metal or ground plane 10, a second like metal or ground plane 12 and an interposed film circuit 13. Conveniently the planes 10 and 12 are thin metal sheets, e.g. of aluminium and have substantially identical arrays of apertures 11 formed therein by, for example, press punching. In the embodiment shown the apertures are rectangular and can be formed as part of a single linear array. The film circuit 13 comprises a printed copper circuit pattern 14*a* on a thin dielectric film 14*b*. When sandwiched between the apertured ground planes part of the copper pattern 14*a* provides probes 14, 16 which extend into the areas of the apertures. The probes are electrically connected to a common feed point by the remainder of the printed circuit pattern 14*a* which forms a feed conductor network in a conventional manner.

Figure 3:
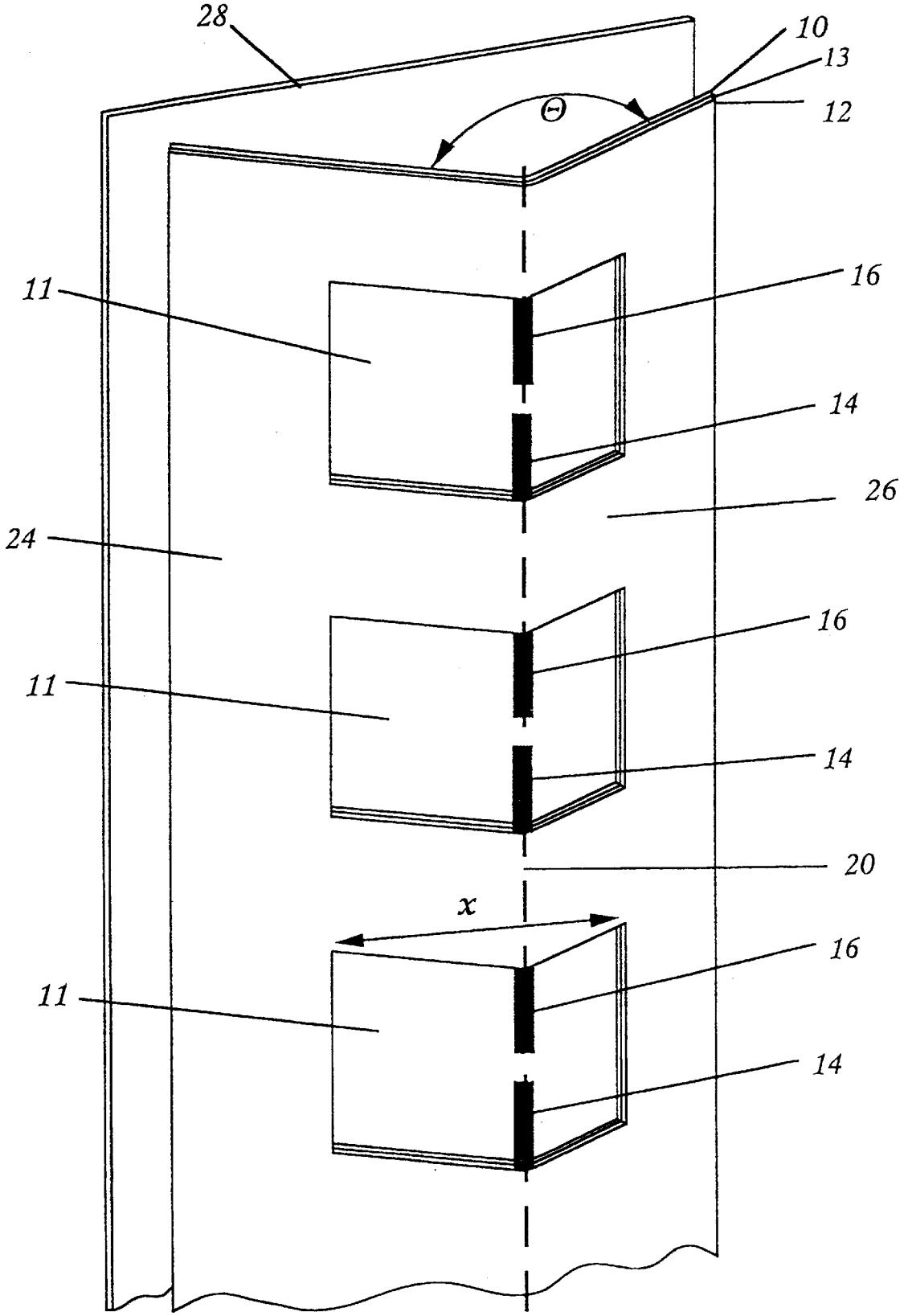
FIG. 3 is a perspective view of a further type of layered antenna.

To achieve a predetermined beam shape in azimuth that is different from the beam shape afforded by a flat antenna structure, the antenna can be deliberately shaped about an axis parallel with the linear array of apertures. In FIG. 3, the triplate structure is creased along an axis 20 substantially co-linear with the linear arrangement of probes 14, 16. The two flat portions 24, 26 of the structure on either side of the crease together define an angle θ. The beamwidth and shape of the radiation pattern of the antenna in azimuth are controlled by the angle θ in conjunction with the transverse dimension x of the apertures. Depending on the required beam shape the angle θ defined by the rear face of the triplate structure may be greater or lesser than 180°. There is provided a flat, unapertured ground plane 28, e.g. a metal plate, situated at a distance behind the array to provide a degree of directionality for the antenna, in order that signals are reflected.

The antenna elements as shown in the above examples are typically mounted upon a frame. Metallic fasteners, apertures and protrusions present on the antenna arrays and ground frames couple with the input signals and radiate at a resonating frequency. These resonant frequency signals couple with the operating frequencies to form intermodulation products, which, as discussed earlier are detrimental to the overall performance of the antenna. Similar coupling occurs with "conventionally" horn antennas and triplate antennas.

Figure 4:
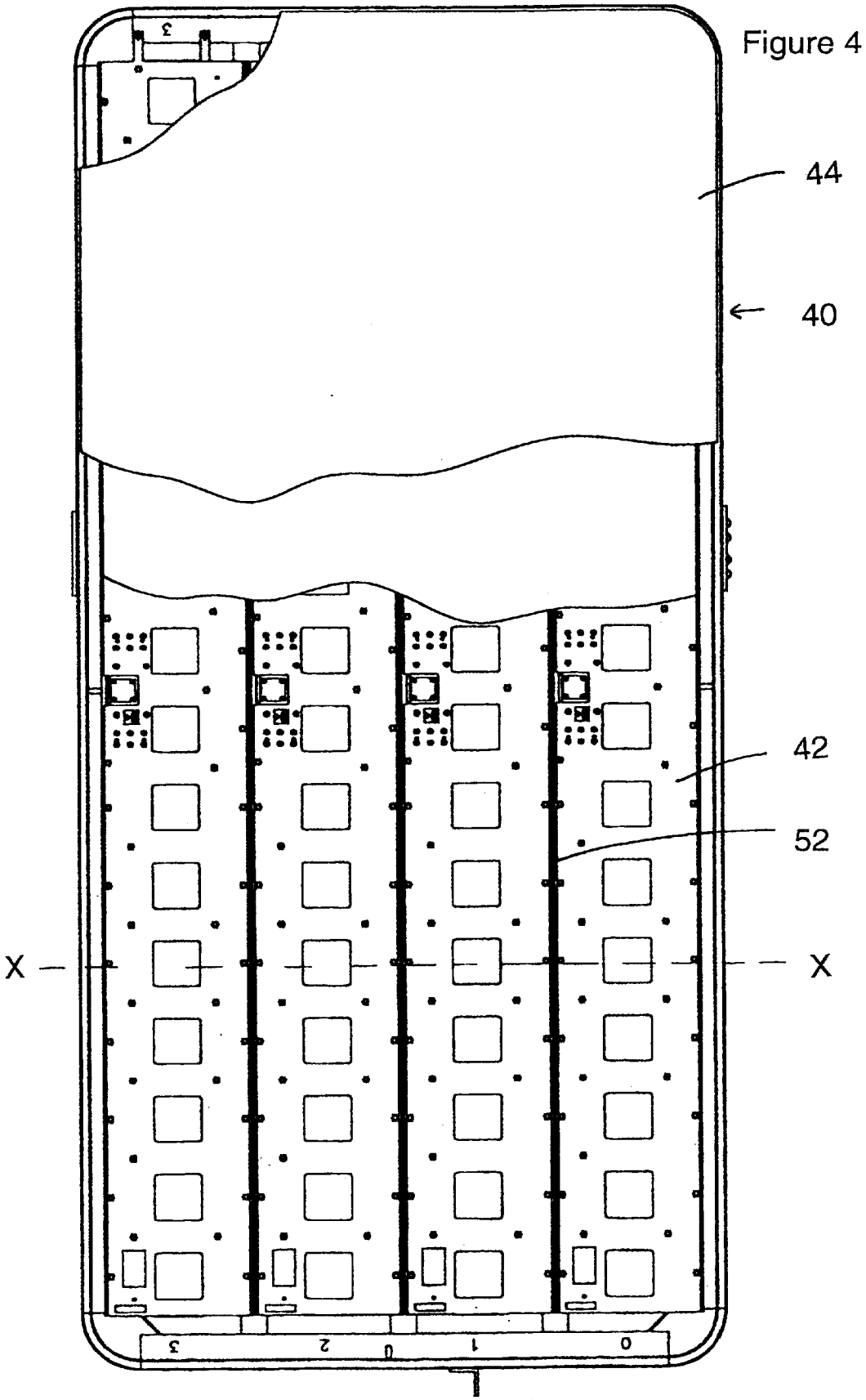
FIG. 4 is a view of a 2-D array antenna facet.
Figure 5:
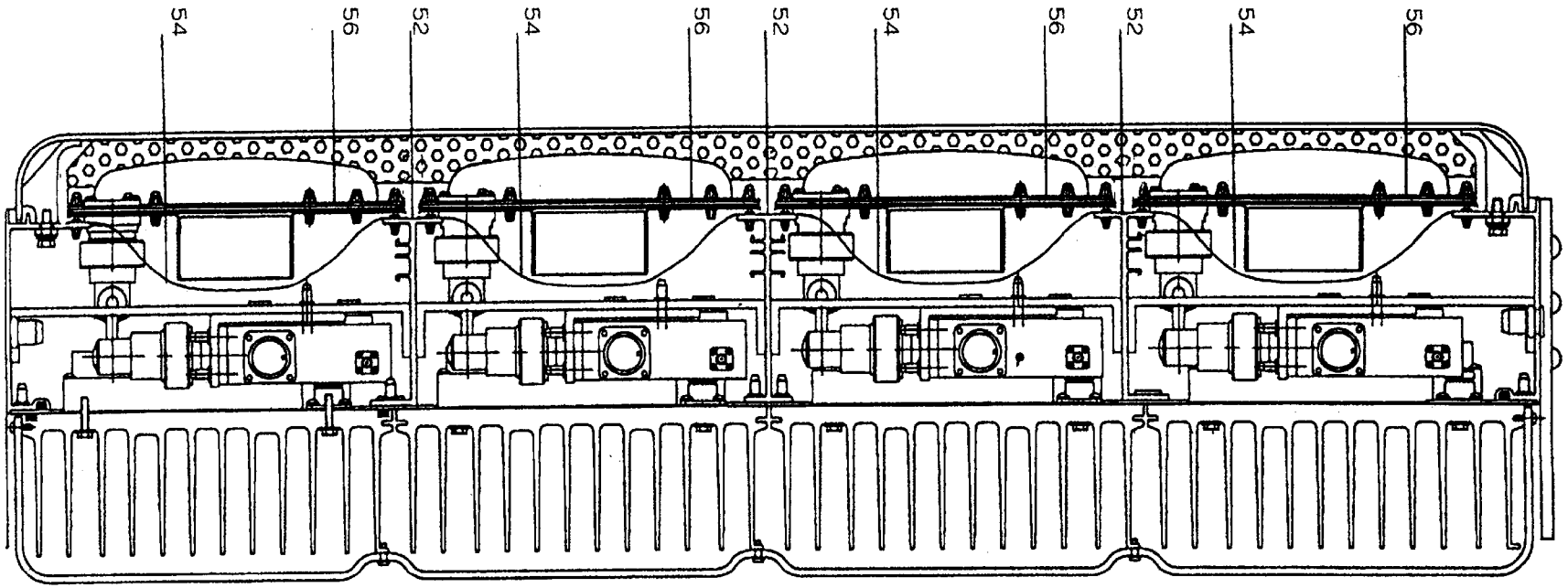
FIG. 5 is a sectional view of the antenna facet shown in FIG. 4 across line X—X.
Figure 6:
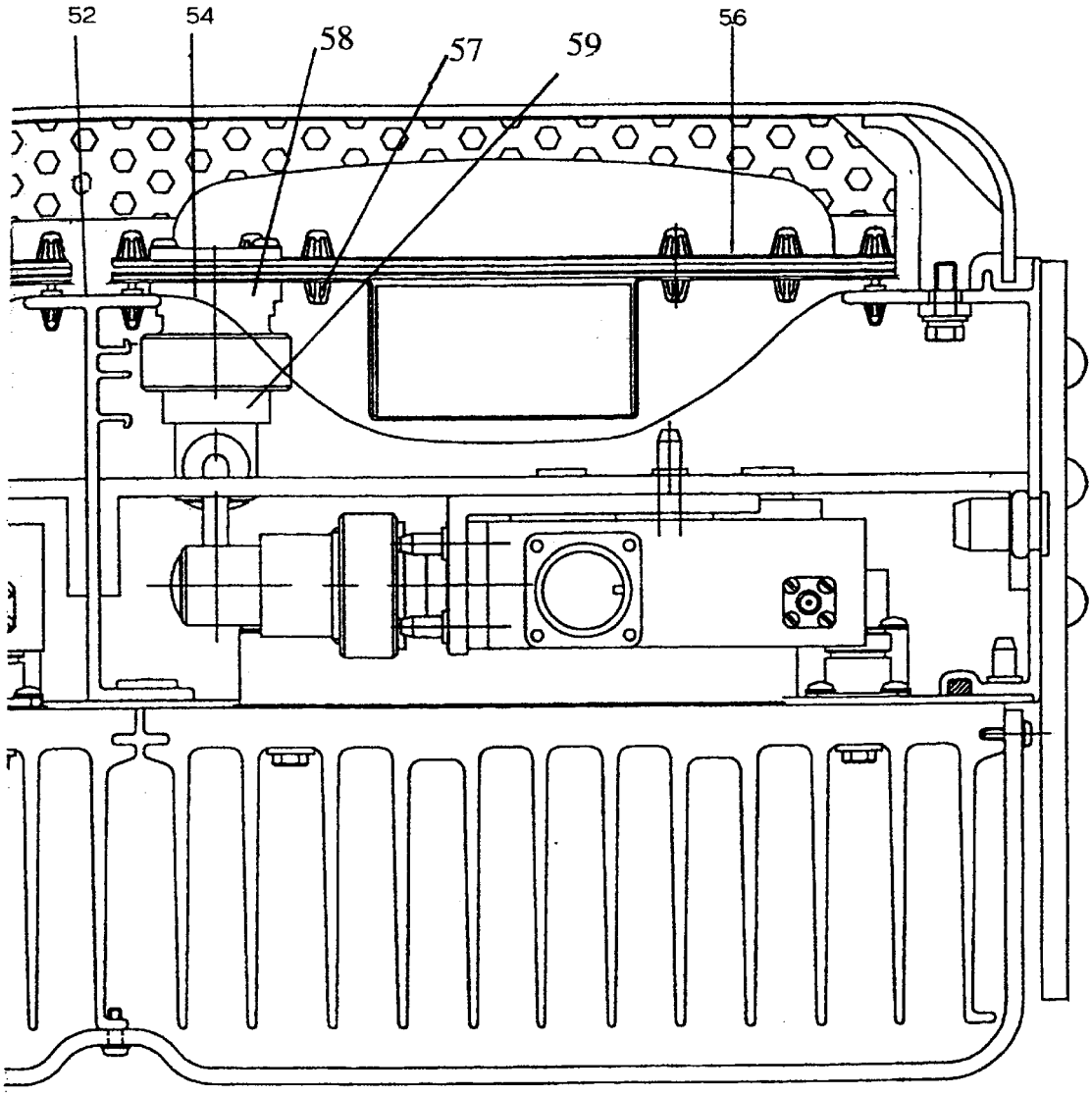
FIG. 6 illustrates a detailed sectional view of one of the antenna arrays shown in FIG. 5.

FIG. 4 shows a facet 40 of an antenna made in accordance with the invention. The facet comprises four linear arrays 42 arranged in a parallel spaced apart relationship, with a radome 44 (shown part cutaway). The antenna arrays are mounted upon a frame 52 as best seen in FIGS. 5 and 6 by means of electrically insulating fasteners, with flexible metallised plastics film placed between the antenna arrays and the support frame. The support frame will be a metal structure and of sufficient strength to support antenna arrays which may be subject to inclement weather conditions.

The utilisation of flexible metallised film can be easily and simply implemented: a single, wide portion of film may be applied to the frame prior to the attachment of the antennas or individual strips of film may be employed for each linear antenna array. The flexible metallised plastics film preferably comprises a layer of metal faced with a layer of plastic on each side. The 3M Corporation produce such a type of product, which is known as: 1900 Series Static Shielding Film. It is possible to create a similar effect with the use of a rubber sheet—wire mesh—rubber sheet arrangement. Other combinations of inflexible insulating layer—metallic layer sheeting and of flexible insulating layer—metallic layer—insulating layer sheeting are possible. One feature of the use of metallised plastics film is that it is non-self supporting.

When the antenna operates in transmission mode, radio signals are fed to the antenna feed network by, for example, input/output feeds 58 from a base station controller, via amplifiers. The feed network divides so that feed probes may radiate within areas defined by apertures in a ground plane of each antenna array. Film 54 effectively contains the radiation emanating rearwardly of the antenna arrays 56 due to coupling with the ground planes of the antennas and fasteners 57; microwave input/output feeds 58 are required to pass through this film to couple with feed ports 59 on the rear face of each antenna element, and apertures may be formed or cut in the film to allow coupling of the input/output ports. Signal loss by way of radiation leaking through gaps and apertures and through reactive coupling effects is effectively prevented by the flexible metallised film. Spurious signals arising from such connections have been found to be insignificant.

It is to be understood that the invention is not restricted to a form of shielding for layered antennas and the use of flexible metallised plastics sheeting is equally applicable to other types of antennas such as dipole-corner reflectors.

What is claimed is:

1. An antenna comprising:

(i) a support frame;

(ii) a plurality of individual antennas mounted on the support frame, said antennas being independently operable to radiate in a forward direction in use and which emit unwanted radiation rearwardly in use;

(iii) a flexible, non-self-supporting sheet comprising a layer of conducting material faced with a layer of insulating material on each side, said sheet being placed between the antennas and the support frame such that in use the unwanted radiation emitted rearwardly from the antennas is substantially contained by the sheet such that intermodulation products are substantially eliminated in use.

2. An antenna assembly as claimed in claim 1 wherein said layer of conducting material is metallic.

3. An antenna assembly as claimed in claim 1 wherein said layers of non-conducting material comprise plastics material.

4. An antenna assembly as claimed in claim 1, each antenna being a layered radiating element comprising a feed network and two apertured ground planes one positioned on each side of the feed network, and a reflector plane.

5. An antenna assembly as claimed in claim wherein the radiating elements each comprise a single radiating aperture.

6. An antenna assembly as claimed in claim 4 wherein the radiating elements are linear arrays and a plurality of such linear arrays are provided, themselves spaced apart in a parallel relationship to form a planar array.

7. A method of transmitting radio signals using an antenna assembly as claimed in claim 1, said method comprising the step of feeding signals to the antennas such that in use radiative coupling effects from one antenna coupling with another antenna due to radiation emitted rearwardly is minimized.

8. A method of receiving radio signals using an antenna assembly as claimed in claim 1, said method comprising the step of receiving signals from the antennas such that in use radiative coupling effects from one antenna coupling with another antenna due to radiation emitted rearwardly is minimized.

9. A method of constructing an antenna assembly comprising a support frame and a plurality of individual antennas, said method comprising the step of:

(i) inserting a flexible, non-self-supporting sheet between the antennas and the support frame, said sheet comprising a layer of conducting material faced with a layer of insulating material on each side, and said sheet comprising one or more apertures; and (ii) connecting the antennas to the support frame using said apertures, such that in use, unwanted radiation emitted rearwardly from the antennas is substantially contained by the sheet such that intermodulation products are substantially eliminated in use.

* * * * *